US010407272B2

(12) United States Patent
Hoover

(10) Patent No.: US 10,407,272 B2
(45) Date of Patent: Sep. 10, 2019

(54) ADJUSTABLE YARN TENSIONER, TEXTILE MACHINE, AND METHOD FOR TENSIONING A CONTINUOUSLY RUNNING YARN

(71) Applicant: American Linc, LLC, Gastonia, NC (US)

(72) Inventor: Donald Lynn Hoover, Cramerton, NC (US)

(73) Assignee: American Linc, LLC, Gastonia, NC (US)

( * ) Notice: Subject to any disclaimer, the term of this patent is extended or adjusted under 35 U.S.C. 154(b) by 73 days.

(21) Appl. No.: 15/751,910

(22) PCT Filed: Aug. 2, 2016

(86) PCT No.: PCT/US2016/045140

§ 371 (c)(1),
(2) Date: Feb. 12, 2018

(87) PCT Pub. No.: WO2017/027257

PCT Pub. Date: Feb. 16, 2017

(65) Prior Publication Data

US 2018/0273338 A1 Sep. 27, 2018

Related U.S. Application Data

(60) Provisional application No. 62/203,549, filed on Aug. 11, 2015.

(51) Int. Cl.

| | |
|---|---|
| ***B65H 59/16*** | (2006.01) |
| ***B65H 59/06*** | (2006.01) |
| ***B65H 59/22*** | (2006.01) |

(52) U.S. Cl.
CPC ..... *B65H 59/16* (2013.01); *B65H 59/06* (2013.01); *B65H 59/225* (2013.01); *B65H 2701/31* (2013.01)

(58) Field of Classification Search
CPC ..... B65H 59/06; B65H 59/16; B65H 59/225; B65H 59/28; B65H 2701/31
See application file for complete search history.

(56) References Cited

U.S. PATENT DOCUMENTS

| | | | |
|---|---|---|---|
| 2,714,494 | A | 8/1955 | Wentz |
| 3,575,360 | A | 4/1971 | Lawson |
| 5,191,847 | A | 3/1993 | Kojima et al. |
| 5,318,155 | A | 6/1994 | Alder et al. |
| 5,423,197 | A | 6/1995 | Roser |
| 2011/0114780 | A1 | 5/2011 | Hoover |
| 2014/0202129 | A1 | 7/2014 | Hoover |

*Primary Examiner* — William E Dondero
(74) *Attorney, Agent, or Firm* — Schwartz Law Firm, P.C.

(57) ABSTRACT

A yarn tensioner is designed for adjusting tension in a running yarn. The yarn tensioner includes a rotatable tension wheel having opposing yarn-contacting surfaces formed along an annular region thereof and configured to frictionally contact opposite sides of the running yarn such that the running yarn causes rotational movement of the tension wheel. An elongated wheel shaft is directly affixed to the tension wheel. A tension adjustment assembly frictionally contacts the wheel shaft, and creates select rotation resistance between adjacent parts of the assembly and the wheel shaft such that rotation of the tension wheel is adjustably frictionally controlled, thereby adjusting tension in the running yarn.

20 Claims, 6 Drawing Sheets

ADJUSTABLE YARN TENSIONER, TEXTILE MACHINE, AND METHOD FOR TENSIONING A CONTINUOUSLY RUNNING YARN

TECHNICAL FIELD AND BACKGROUND

The present disclosure relates broadly and generally to the textile industry, and more particularly to an adjustable yarn tensioner, textile machine, and method for tensioning a continuously running yarn. In one exemplary embodiment, the disclosure further comprises a cannister- (or pot-)yarn tensioning device in a direct-cabling textile machine. Direct cabling is a common yarn processing technique in the formation of high-quality pile during the manufacture of rugs and carpets. According to this process, two yarns are twisted around each other in a single operation without the individual strands themselves being twisted.

SUMMARY OF EXEMPLARY EMBODIMENTS

Various exemplary embodiments of the present disclosure are described below. Use of the term "exemplary" means illustrative or by way of example only, and any reference herein to "the invention" is not intended to restrict or limit the invention to exact features or steps of any one or more of the exemplary embodiments disclosed in the present specification. References to "exemplary embodiment," "one embodiment," "an embodiment," "various embodiments," and the like, may indicate that the embodiment(s) of the invention so described may include a particular feature, structure, or characteristic, but not every embodiment necessarily includes the particular feature, structure, or characteristic. Further, repeated use of the phrase "in one embodiment," or "in an exemplary embodiment," do not necessarily refer to the same embodiment, although they may.

It is also noted that terms like "preferably", "commonly", and "typically" are not utilized herein to limit the scope of the claimed invention or to imply that certain features are critical, essential, or even important to the structure or function of the claimed invention. Rather, these terms are merely intended to highlight alternative or additional features that may or may not be utilized in a particular embodiment of the present invention.

According to one exemplary embodiment, the present disclosure comprises a yarn tensioner designed for adjusting tension in a running yarn. The yarn tensioner includes a rotatable tension wheel having opposing yarn-contacting surfaces formed along an annular region thereof and configured to frictionally contact opposite sides of the running yarn such that the running yarn causes rotational movement of the tension wheel. An elongated wheel shaft is directly affixed to the tension wheel. A tension adjustment assembly frictionally contacts the wheel shaft, and creates select rotation resistance between adjacent parts of the assembly and the wheel shaft such that rotation of the tension wheel is adjustably frictionally controlled, thereby adjusting tension in the running yarn.

According to another exemplary embodiment, a bearing housing is operatively secured to the tension wheel, such that the tension wheel is rotatable relative to the bearing housing.

According to another exemplary embodiment, the wheel shaft comprises a perforated brake disc located within the bearing housing and directly affixed to a distal end of the wheel shaft. The brake disc defines a plurality of perforations extending therethrough from a first side of the brake disc to an opposite second side of the brake disc.

According to another exemplary embodiment, a plurality of stacked friction balls are arranged within each perforation of the brake disc, and have respective portions thereof extending from the first and second sides of the brake disc. The friction balls are loosely arranged within the perforations such that the balls are capable of freely rotating relative to one another. Alternatively, a single friction ball may be loosely arranged for rotation within a single perforation of the brake disc with portions of the single friction ball extending from the first and second sides of the brake disc.

According to another exemplary embodiment, first and second thrust bearing races are located adjacent respective opposite sides of the brake disc, and contact respective portions of stacked friction balls extending from the brake disc.

According to another exemplary embodiment, the second thrust bearing race is seated on an interior annular flange of the bearing housing, and resides in a fixed position between the brake disc and the tension wheel.

According to another exemplary embodiment, at least one compression spring is located adjacent the first thrust bearing race, and is adapted for engaging the first thrust bearing race to adjustably urge the stacked friction balls together towards the second thrust bearing race and against cylindrical walls of the disc perforations. Increasing compression in the spring increases a braking force on the brake disc and the rotation-resistance of the tension wheel, thereby increasing tension in the running yarn. Reducing compression in the spring reduces a braking force on the brake disc and the rotation-resistance of the tension wheel, thereby reducing tension in the running yarn.

According to another exemplary embodiment, the bearing housing comprises a threaded distal end.

According to another exemplary embodiment, a threaded tension-adjustment cap is adjustably attached to the distal end of the bearing housing and operatively engages the spring. Turning the tension-adjustment cap in clockwise and counterclockwise directions selectively adjusts compression in the spring.

According to another exemplary embodiment, a measurement band is applied to the tension-adjustment cap, and comprises markings for identifying a tension setting of the yarn tensioner.

In yet another exemplary embodiment, the present disclosure comprises a yarn supply canister for use in a direct-cabling textile machine. The supply canister includes a canister housing designed for holding a yarn supply package upstream of the textile machine. A first yarn guide is located inside the canister housing for receiving running yarn pulled from the supply package at an unwinding tension. A second yarn guide is downstream of the first yarn guide, and is adapted for guiding running yarn from the canister housing to the textile machine. A yarn tensioner is located between the first and second yarn guides, and is adapted for adjusting unwinding tension in the running such that yarn exits the canister housing at an adjusted delivery tension. The yarn tensioner comprises a rotatable tension wheel having opposing yarn-contacting surfaces formed along an annular region thereof, and configured to frictionally contact opposite sides of the running yarn such that the running yarn causes rotational movement of the tension wheel. An elongated wheel shaft is directly affixed to the tension wheel. A tension adjustment assembly frictionally contacts the wheel shaft, and creates select rotation resistance between adjacent parts of the assembly and the wheel shaft such that rotation of the tension wheel is adjustably frictionally controlled, thereby adjusting tension in the running yarn.

Use of the terms "upstream" and "downstream" refer herein to relative locations (or movement) of elements or structure to other elements or structure along or adjacent the path of yarn travel. In other words, a first element or structure which is encountered along or adjacent the path of yarn travel before a second element or structure is considered to be "upstream" of the second element or structure, and the second element structure is considered to be "downstream" of the first.

In an exemplary embodiment, the yarn-contacting surfaces of the rotatable tension wheel comprise closely spaced and circumferentially offset inserts (or "teeth"). The term "closely spaced" means sufficiently spaced apart to allow serpentine passage of the yarn between the yarn-contacting surfaces such that the yarn frictionally contacts the surfaces to adjust downstream tension. The term "serpentine" is used broadly herein to mean a uniformly (or non-uniformly) winding or snake-like formation. Additionally, the yarn-contacting teeth may comprise a material coating, such as ceramic and plasma. Alternatively, the teeth may be fabricated of an anodized aluminum or solid ceramic.

The term "sequentially spaced" is defined herein to mean the physical and/or temporal spacing of elements or structure downstream along or adjacent the path of yarn travel.

The term "housing" refers broadly herein to any open, closed, or partially open or partially closed structure.

BRIEF DESCRIPTION OF THE DRAWINGS

The description of exemplary embodiments proceeds in conjunction with the following drawings, in which.

DESCRIPTION OF EXEMPLARY EMBODIMENTS AND BEST MODE

The present invention is described more fully hereinafter with reference to the accompanying drawings, in which one or more exemplary embodiments of the invention are shown. Like numbers used herein refer to like elements throughout. This invention may, however, be embodied in many different forms and should not be construed as limited to the embodiments set forth herein; rather, these embodiments are provided so that this disclosure will be operative, enabling, and complete. Accordingly, the particular arrangements disclosed are meant to be illustrative only and not limiting as to the scope of the invention, which is to be given the full breadth of the appended claims and any and all equivalents thereof. Moreover, many embodiments, such as adaptations, variations, modifications, and equivalent arrangements, will be implicitly disclosed by the embodiments described herein and fall within the scope of the present invention.

Although specific terms are employed herein, they are used in a generic and descriptive sense only and not for purposes of limitation. Unless otherwise expressly defined herein, such terms are intended to be given their broad ordinary and customary meaning not inconsistent with that applicable in the relevant industry and without restriction to any specific embodiment hereinafter described. As used herein, the article "a" is intended to include one or more items. Where only one item is intended, the term "one", "single", or similar language is used. When used herein to join a list of items, the term "or" denotes at least one of the items, but does not exclude a plurality of items of the list.

For exemplary methods or processes of the invention, the sequence and/or arrangement of steps described herein are illustrative and not restrictive. Accordingly, it should be understood that, although steps of various processes or methods may be shown and described as being in a sequence or temporal arrangement, the steps of any such processes or methods are not limited to being carried out in any particular sequence or arrangement, absent an indication otherwise. Indeed, the steps in such processes or methods generally may be carried out in various different sequences and arrangements while still falling within the scope of the present invention.

Additionally, any references to advantages, benefits, unexpected results, or operability of the present invention are not intended as an affirmation that the invention has been previously reduced to practice or that any testing has been performed. Likewise, unless stated otherwise, use of verbs in the past tense (present perfect or preterit) is not intended to indicate or imply that the invention has been previously reduced to practice or that any testing has been performed.

Figure 1:
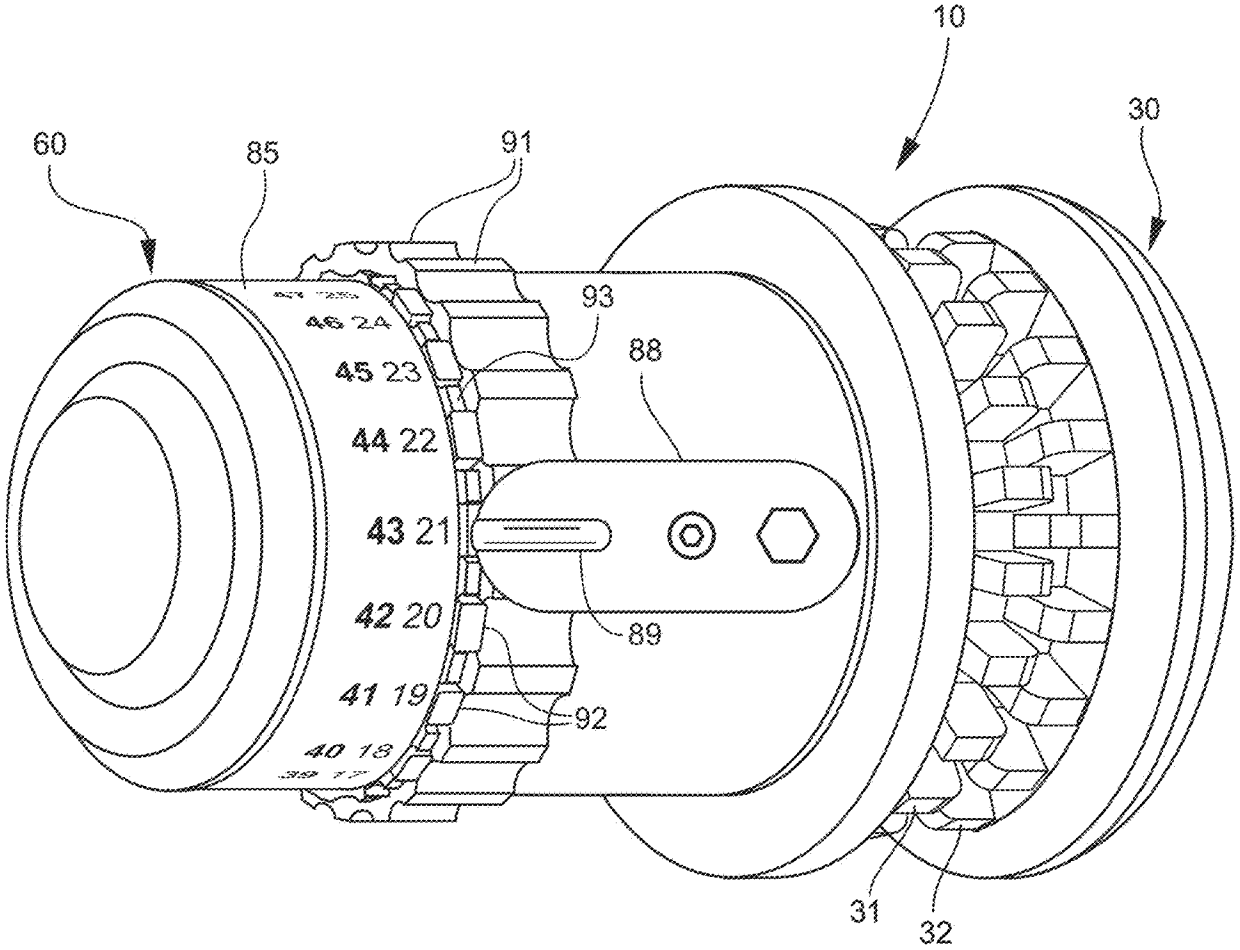
FIG. 1 is a perspective view of an adjustable yarn tensioner according to one exemplary embodiment of the present disclosure.
Figure 2:
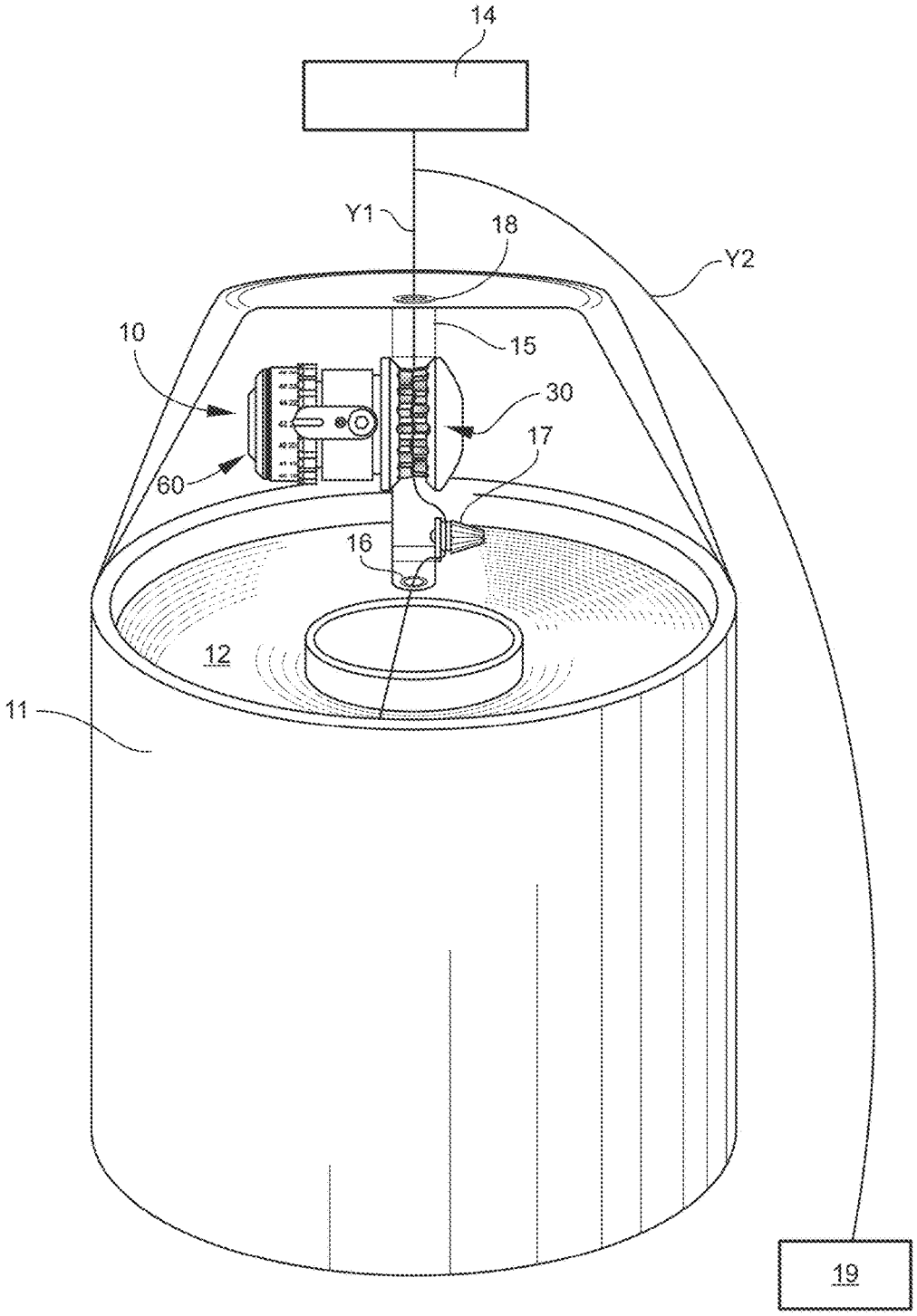
FIG. 2 is an environmental perspective view of the adjustable yarn tensioner mounted inside a supply canister.

Referring now specifically to the drawings, an adjustable yarn tensioner according to one exemplary embodiment of the present invention is illustrated in FIGS. 1 and 2, and shown generally at reference numeral 10. As shown in FIG. 2, the exemplary yarn tensioner 10 is located inside a supply canister 11 between an upstream yarn feed package 12 (e.g., single ply filament) and a downstream textile machine—indicated schematically at 14. The textile machine 14 may be a conventional direct-cabling machine used to form high-quality pile in the manufacture of rugs and carpets.

In a direct-cabling machine, the feed package 12 is loaded into the cannister 11 and the yarn Y1 unwound and tensioned using a tensioning device or "yarn brake", such as the present adjustable tensioner 10. The yarn tensioner 10 may be suspended above the package 12 inside the canister 11 by mounting bracket 15 or other suitable structure. The mounting bracket 15 has a yarn guide 16 and pre-tensioner 17 upstream of the tensioner 10. The pre-tensioner 17 functions to tension the running yarn immediately prior to its passage to the exemplary tensioner 10. An annular guide 18 is located at a top wall of the cannister 11 downstream of the tensioner 10. A second feed package (not shown) is loaded into a creel, unwound, and slightly tensioned before it enters a lower hollow shaft of a spindle. This yarn end Y2 wraps around a storage disc 19 and forms a balloon around the cannister 11. At the balloon apex outside of guide 18, both yarns Y1, Y2 meet and wrap around each other, which thus dissolves the false twist in the balloon yarn Y2. At the meeting point, both yarns Y1, Y2 should have substantially the same tension in order to form a balanced composite yarn with no or limited residual torque and substantially equal lengths of component yarns. Consequently, whenever the spindle speed is altered, tension in the cannister yarn Y1 is adjusted by yarn tensioner 10 to compensate for a consequent increase or decrease in tension of the balloon yarn Y2.

As yarn is pulled from the feed package 12 and fed through pre-tensioner 17, the yarn tensioner 10 interposed between the package 12 and downstream textile machine 14 applies predetermined (e.g., calibrated) frictional resistance to the running yarn Y1, such that the delivery tension is maintained at a generally uniform, constant and predictable level. Exemplary embodiments of the present yarn tensioner 10, described below, comprise means for precisely setting and adjusting delivery tension in the cannister yarn Y1. In alternative applications, the yarn tensioner 10 may also be used in the creel on the cabler, in other types of creels, and in other various textile machines and processes.

Figure 3:
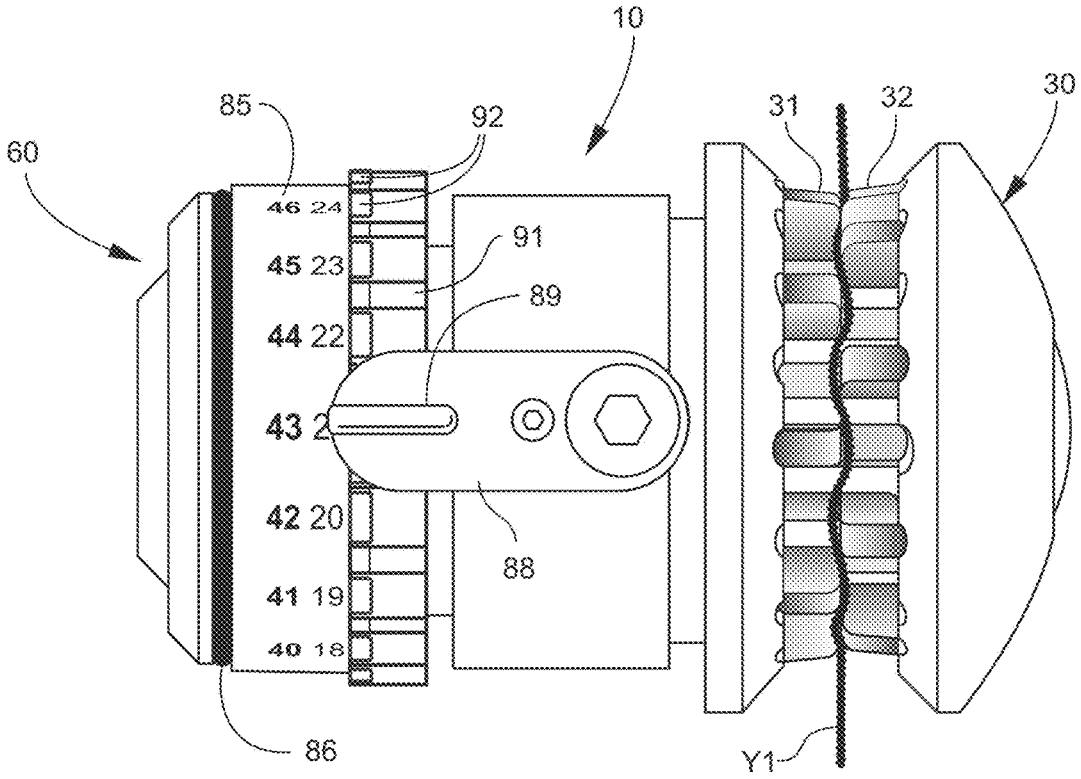
FIG. 3 is a side view of the exemplary yarn tensioner illustrating the travel path of running yarn along an annular region of the rotatable tension wheel.

Referring to FIGS. 1, 2 and 3, the exemplary yarn tensioner 10 comprises a rotatable tension wheel 30 having opposing closely spaced yarn-contacting surfaces 31, 32 formed along an annular region of the wheel 30. The yarn-contacting surfaces 31, 32 define a generally serpentine yarn path configured to longitudinally align with the annular guide 18 of cannister 11. In one embodiment, the yarn-contacting surfaces 31, 32 are formed by a plurality of spaced apart and circumferentially offset inserts (or "teeth") arranged to frictionally contact opposite sides of the running yarn Y1 such that the running yarn causes rotational movement of the tension wheel 30. A tension adjustment assembly, described further below, controls rotation resistance of the tension wheel 30, thereby adjusting tension in the running yarn Y1 relative to that of the balloon yarn Y2. The exemplary teeth forming surfaces 31, 32 of the tension wheel 30 are individually formed, and may comprise a material coating, such as ceramic or plasma, or may be fabricated of an anodized aluminum or solid ceramic.

Figure 4:
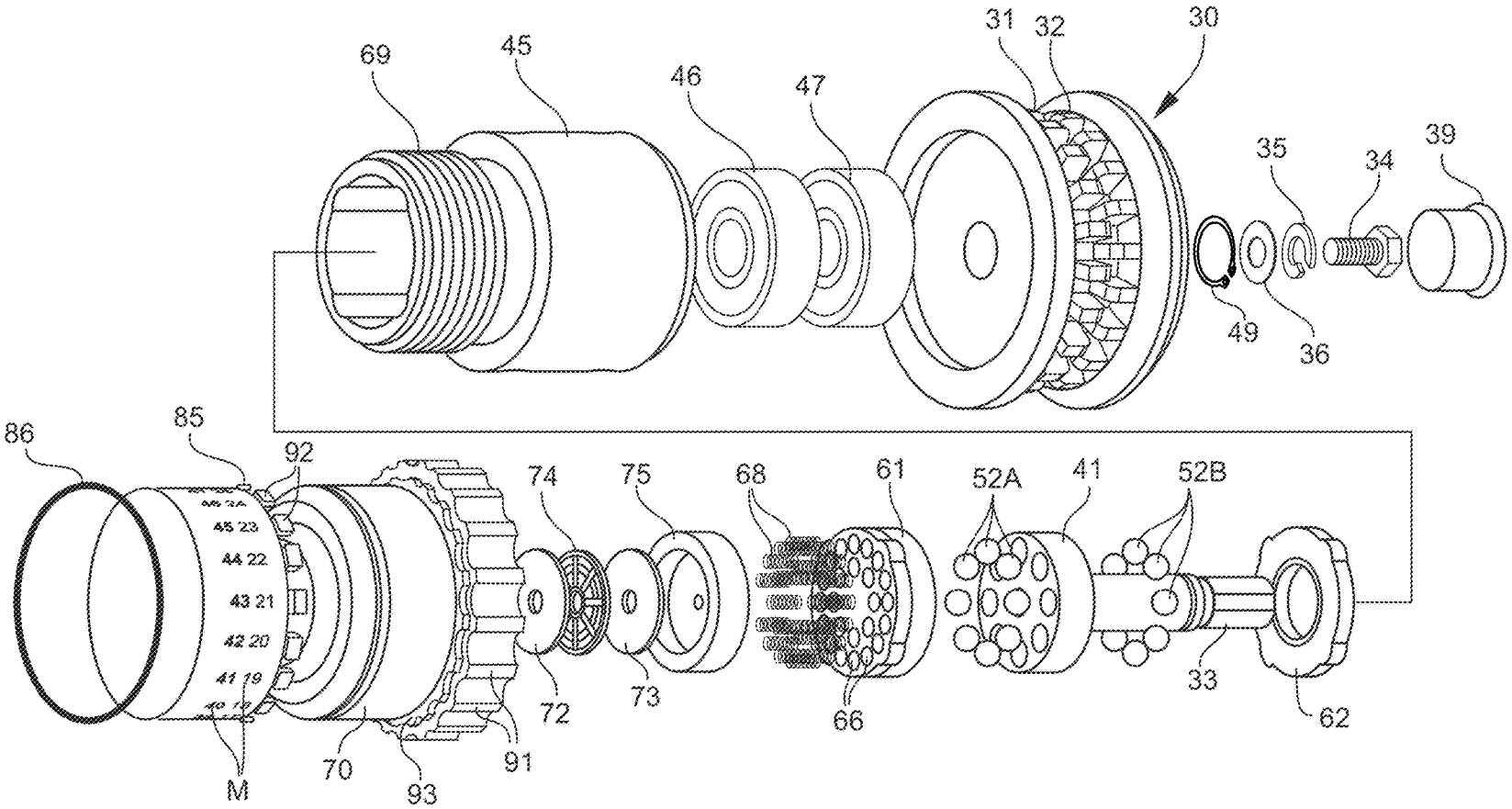
FIG. 4 is an exploded perspective view of the adjustable yarn tensioner.
Figure 5:
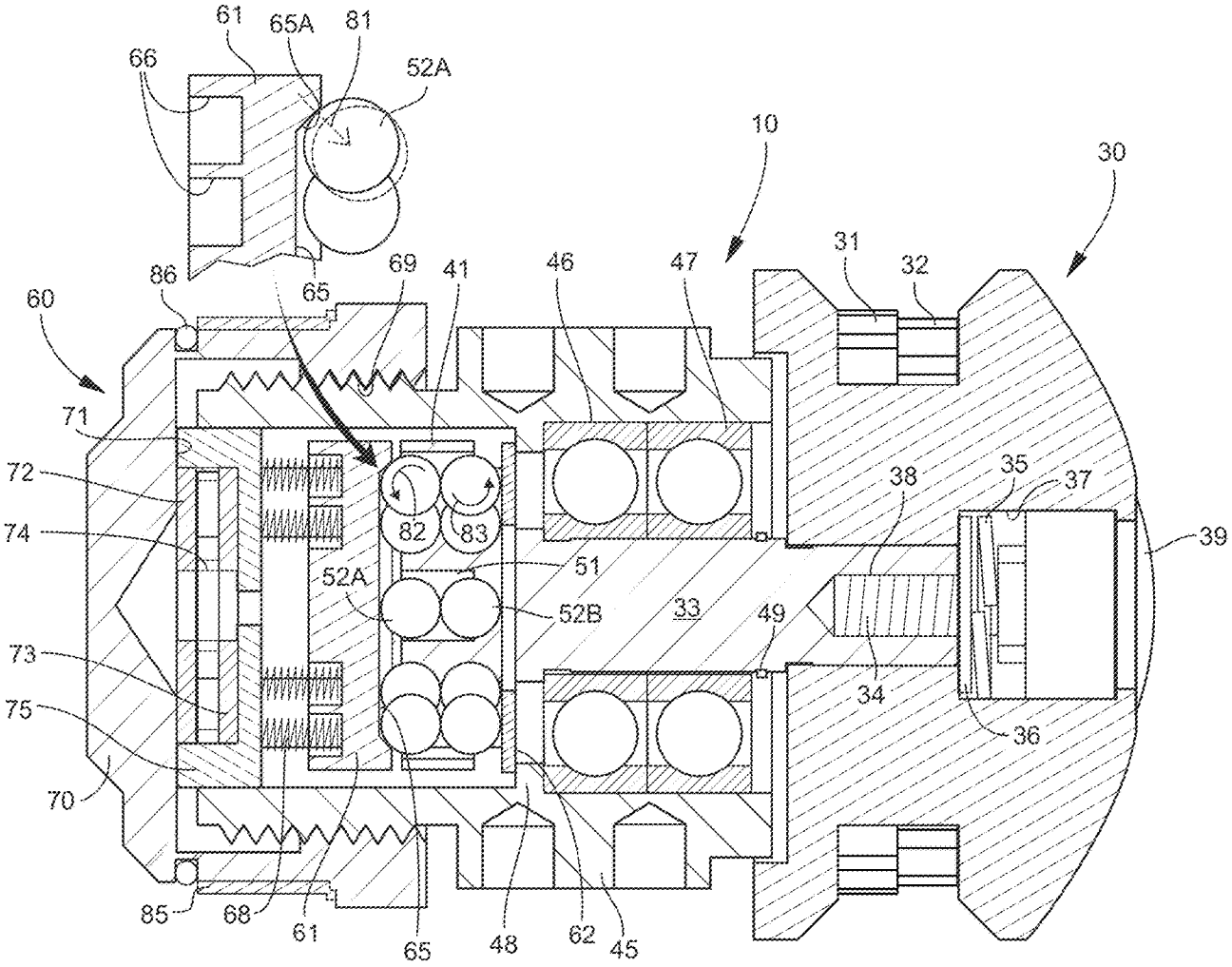
FIGS. 5 and 6 are cross-sectional views of the exemplary yarn tensioner.

As best shown in FIGS. 4 and 5, an elongated wheel shaft 33 is directly affixed to the tension wheel 30 by threaded fastener 34, lock washer 35, and flat washer 36. The threaded fastener 34 is received within a central cavity 37 of the tension wheel 30, and mates with a complementary threaded opening 38 formed at a proximal end of the wheel shaft 33. Fastener cover 39 closes cavity 37. A perforated brake disc 41 is directly affixed to a distal end of the wheel shaft 33, and resides inside a generally hollow bearing housing 45. The bearing housing 45 is operatively secured to the tension wheel 30, such that the tension wheel 30 is rotatable relative to the housing 45. Annular housing bearings 46, 47 are carried on the wheel shaft 33 between the brake disc 41 and tension wheel 30, and are held inside the housing 45 between an annular interior flange 48 and retention ring 49 secured to the shaft 33.

The exemplary brake disc 41 defines a plurality of cylindrical perforations 51 formed through the disc 41 from one side to an opposite side. Two or more stacked steel friction balls 52A, 52B are located within each perforation 51 of the brake disc 41, and have respective portions which project outwardly from both sides of the disc 41. The friction balls 52A, 52B are loosely arranged (or "float") within each cylindrical perforation 51 such that the balls 52A, 52B are capable of freely rotating relative to one another upon rotation of the tension wheel 30.

The tension adjustment assembly 60 comprises parts designed to frictionally contact the brake disc 41 of the wheel shaft 33, and thereby control rotation resistance of the tension wheel 30. In one exemplary embodiment, first and second thrust bearing races 61, 62 are located adjacent respective opposite sides of the brake disc 41, and contact respective portions of the stacked friction balls 52A, 52B projecting from the disc 41. The second thrust bearing race 62 is seated on the interior flange 48 of bearing housing 45, and resides in a fixed position relative to the brake disc 41 and the tension wheel 30. The first thrust bearing race 61 has a ball-side chamfered recess 65, and an opposite side defining a number of small cavities 66 designed for holding a corresponding number of metal compression springs 68.

The exemplary bearing housing 45 has a threaded distal end 69 designed to receive a complementary threaded tension-adjustment cap 70. The tension-adjustment cap 70 comprises an interior end wall 71 adjacent thrust washers 72, 73 and thrust bearing 74 all located within a thrust bearing housing 75. The thrust bearing housing 75 resides adjacent the compression springs 68. Turning the tension-adjustment cap 70 in clockwise and counterclockwise directions moves the cap 70 inwardly and outwardly relative to the tension wheel 30, and thereby selectively adjusts compression in the springs 68. Increasing compression in the springs 68 increases a braking or drag force on the brake disc 41 and the rotation-resistance of the tension wheel 30, thereby increasing tension in the running yarn Y1. Reducing compression in the springs 68 reduces the braking or drag force on the brake disc 41 and the rotation-resistance of the tension wheel 30, thereby reducing tension in the running yarn Y1.

Figure 6:
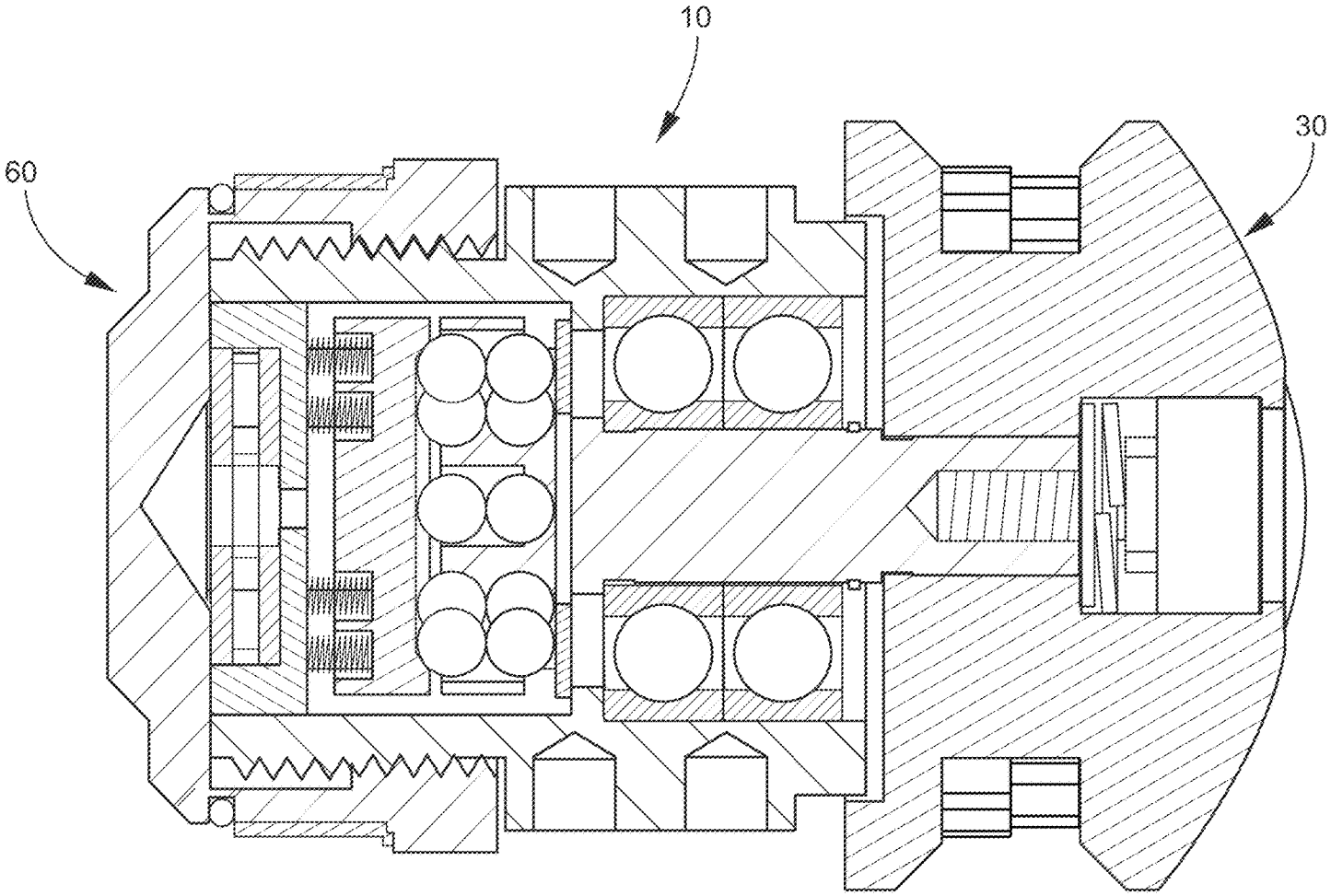

FIGS. 5 and 6 show the tension-adjustment cap 70 located at different tension settings. In each case, the first thrust bearing race 61 contacts the exposed steel friction balls 52A at its chamfered side wall 65A, such that the bearing force applied by the springs 68 is directed at a slightly inward angle indicated by arrow 81. As the tension wheel 30 is driven by the running yarn Y1, the stacked friction balls 52A, 52B rotate relative to one another as indicated by arrows 82 and 83 in a manner similar to a gear drive. Friction is created by the balls 52A, 52B being urged together towards the second thrust bearing race 62 and against the cylindrical walls of the disc perforations 51. By turning (or tightening) the tension-adjustment cap 70 relative to the housing 45, as shown in FIG. 6, the springs 68 become further compressed creating an increased braking or drag force on the brake disc 41. As stated above, this increased force increases the rotation-resistance of the tension wheel 30, and thereby increases tension in the running yarn Y1. Various predetermined tension or drag settings may be identified by adjustment markings "M" on a measurement band 85 applied to the tension-adjustment cap 70 and secured by O-ring 86.

As best shown in FIGS. 1 and 3, a spring-biased indexer 88 comprises an elongated inwardly-directed detent 89 designed to selectively locate between adjacent teeth 91 of the tension-adjustment cap 70 to temporarily hold the selected tension setting during operation of the yarn tensioner 10. The exemplary tensioner 10 may include available settings within a graduated tension range of approximately 40 grams to 2000 grams. The exemplary measurement band 85 may comprise a series of circumferentially spaced index tabs 92 designed to reside between respective points of a scalloped ridge 93 (FIG. 4) formed adjacent the teeth 91 of tension-adjustment cap 70. The removable O-ring 86 and index tabs 92 cooperate to hold the measurement band 85 in place, and allow the band 85 to be removed and rotated in order to re-calibrate the tensioner 10, if necessary.

For the purposes of describing and defining the present invention it is noted that the use of relative terms, such as "substantially", "generally", "approximately", and the like, are utilized herein to represent an inherent degree of uncertainty that may be attributed to any quantitative comparison, value, measurement, or other representation. These terms are also utilized herein to represent the degree by which a quantitative representation may vary from a stated reference without resulting in a change in the basic function of the subject matter at issue.

Exemplary embodiments of the present invention are described above. No element, act, or instruction used in this description should be construed as important, necessary, critical, or essential to the invention unless explicitly described as such. Although only a few of the exemplary embodiments have been described in detail herein, those skilled in the art will readily appreciate that many modifications are possible in these exemplary embodiments without materially departing from the novel teachings and advantages of this invention. Accordingly, all such modifications are intended to be included within the scope of this invention as defined in the appended claims.

In the claims, any means-plus-function clauses are intended to cover the structures described herein as performing the recited function and not only structural equivalents, but also equivalent structures. Thus, although a nail and a screw may not be structural equivalents in that a nail employs a cylindrical surface to secure wooden parts together, whereas a screw employs a helical surface, in the environment of fastening wooden parts, a nail and a screw may be equivalent structures. Unless the exact language "means for" (performing a particular function or step) is recited in the claims, a construction under 35 U.S.C. § 112(f) [or 6th paragraph/pre-AIA] is not intended. Additionally, it is not intended that the scope of patent protection afforded the present invention be defined by reading into any claim a limitation found herein that does not explicitly appear in the claim itself.

What is claimed:

1. A yarn tensioner adapted for adjusting tension in a running yarn, comprising:

a rotatable tension wheel having opposing yarn-contacting surfaces formed along an annular region thereof and configured to frictionally contact opposite sides of the running yarn such that the running yarn causes rotational movement of said tension wheel;

an elongated wheel shaft directly affixed to said tension wheel;

a tension adjustment assembly frictionally contacting said wheel shaft, and creating select rotation resistance between adjacent parts of said assembly and said wheel shaft such that rotation of said tension wheel is adjustably frictionally controlled, thereby adjusting tension in the running yarn.

2. The yarn tensioner according to claim 1, and comprising a bearing housing operatively secured to said tension wheel, wherein said tension wheel is rotatable relative to said bearing housing.

3. The yarn tensioner according to claim 2, wherein said wheel shaft comprises a perforated brake disc located within said bearing housing and directly affixed to a distal end of said wheel shaft, and said brake disc defining a plurality of perforations extending therethrough from a first side of said brake disc to an opposite second side of said brake disc.

4. The yarn tensioner according to claim 3, and comprising a plurality of stacked friction balls arranged within each perforation of said brake disc, and having respective portions thereof extending from the first and second sides of said brake disc.

5. The yarn tensioner according to claim 4, and comprising first and second thrust bearing races located adjacent respective sides of said brake disc, and contacting respective portions of stacked friction balls extending from said brake disc.

6. The yarn tensioner according to claim 5, wherein said second thrust bearing race is seated on an interior annular flange of said bearing housing, and resides in a fixed position between said brake disc and said tension wheel.

7. The yarn tensioner according to claim 6, and comprising at least one compression spring adjacent said first thrust bearing race, and adapted for engaging said first thrust bearing race to adjustably urge said stacked friction balls together towards said second thrust bearing race, whereby:

(i) increasing compression in said spring increases a braking force on said brake disc and the rotation-resistance of said tension wheel, thereby increasing tension in the running yarn; and (ii) reducing compression in said spring reduces a braking force on said brake disc and the rotation-resistance of said tension wheel, thereby reducing tension in the running yarn.

8. The yarn tensioner according to claim 7, wherein said bearing housing comprises a threaded distal end.

9. The yarn tensioner according to claim 8, and comprising a threaded tension-adjustment cap adjustably attached to the distal end of said bearing housing and operatively engaging said spring, such that turning said tension-adjustment cap in clockwise and counterclockwise directions selectively adjusts compression in said spring.

10. The yarn tensioner according to claim 9, and comprising a measurement band applied to said tension-adjustment cap, and comprising markings for identifying a tension setting of said yarn tensioner.

11. A yarn supply canister for use in a direct-cabling textile machine, said supply canister comprising:

a canister housing designed for holding a yarn supply package upstream of the textile machine;

a first yarn guide located inside said canister housing for receiving running yarn pulled from the supply package at an unwinding tension;

a second yarn guide downstream of said first yarn guide, and adapted for guiding running yarn from said canister housing to the textile machine;

a yarn tensioner located between said first and second yarn guides, and adapted for adjusting unwinding tension in the running such that yarn exits said canister housing at an adjusted delivery tension, said yarn tensioner comprising:

a rotatable tension wheel having opposing yarn-contacting surfaces formed along an annular region thereof and configured to frictionally contact opposite sides of the running yarn such that the running yarn causes rotational movement of said tension wheel;

an elongated wheel shaft directly affixed to said tension wheel;

a tension adjustment assembly frictionally contacting said wheel shaft, and creating select rotation resistance between adjacent parts of said assembly and said wheel shaft such that rotation of said tension wheel is adjustably frictionally controlled, thereby adjusting tension in the running yarn.

12. The yarn supply canister according to claim 11, and comprising a bearing housing operatively secured to said tension wheel, wherein said tension wheel is rotatable relative to said bearing housing.

13. The yarn supply canister according to claim 12, wherein said wheel shaft comprises a perforated brake disc located within said bearing housing and directly affixed to a distal end of said wheel shaft, and said brake disc defining a plurality of perforations extending therethrough from a first side of said brake disc to an opposite second side of said brake disc.

14. The yarn supply canister according to claim 13, and comprising a plurality of stacked friction balls arranged within each perforation of said brake disc, and having respective portions thereof extending from the first and second sides of said brake disc.

15. The yarn supply canister according to claim 14, and comprising first and second thrust bearing races located adjacent respective sides of said brake disc, and contacting respective portions of stacked friction balls extending from said brake disc.

16. The yarn supply canister according to claim 15, wherein said second thrust bearing race is seated on an interior annular flange of said bearing housing, and resides in a fixed position between said brake disc and said tension wheel.

17. The yarn supply canister according to claim 16, and comprising at least one compression spring adjacent said first thrust bearing race, and adapted for engaging said first thrust bearing race to adjustably urge said stacked friction balls together towards said second thrust bearing race, whereby:

(i) increasing compression in said spring increases a braking force on said brake disc and the rotation-resistance of said tension wheel, thereby increasing tension in the running yarn; and (ii) reducing compression in said spring reduces a braking force on said brake disc and the rotation-resistance of said tension wheel, thereby reducing tension in the running yarn.

18. The yarn supply canister according to claim 17, wherein said bearing housing comprises a threaded distal end.

19. The yarn supply canister according to claim 18, and comprising a threaded tension-adjustment cap adjustably attached to the distal end of said bearing housing and operatively engaging said spring, such that turning said tension-adjustment cap in clockwise and counterclockwise directions selectively adjusts compression in said spring.

20. The yarn supply canister according to claim 19, and comprising a measurement band applied to said tension-adjustment cap, and comprising markings for identifying a tension setting of said yarn tensioner.

* * * * *